United States Patent [19]

Ethridge

[11] Patent Number: 4,831,908

[45] Date of Patent: May 23, 1989

[54] PACKAGE WIND CUTTER

[75] Inventor: Fredrick A. Ethridge, Waxhaw, N.C.

[73] Assignee: Lummus Industries, Inc., Columbus, Ga.

[21] Appl. No.: 6,154

[22] Filed: Jan. 23, 1987

[51] Int. Cl.[4] ..... D01G 1/04

[52] U.S. Cl. ..... 83/346; 83/913; 83/403

[58] Field of Search ..... 83/37, 346, 913, 403; 242/157 R; 254/389; 226/196

[56] References Cited

U.S. PATENT DOCUMENTS

| | | | |
|---|---|---|---|
| 1,662,475 | 3/1928 | Royce | 242/157 R |
| 3,557,648 | 1/1971 | Coffin et al. | 83/913 |
| 3,768,355 | 10/1973 | Farmer et al. | 83/913 |
| 4,169,397 | 10/1979 | Vehling | 83/913 |
| 4,519,281 | 5/1985 | Spaller | 83/37 |
| 4,630,515 | 12/1986 | Spaller | 83/913 |

*Primary Examiner*—Frank T. Yost
*Assistant Examiner*—Scott A. Smith
*Attorney, Agent, or Firm*—Jennings, Carter, Thompson & Veal

[57] ABSTRACT

An improved package wind cutter utilizes a specially configured guide hook carried on the periphery of a reduced diameter winder dome to eliminate the need for a pressure roller mounted internally of the winder dome, thereby simplifying the manufacture, operation and maintenance of the apparatus and appreciably improving the strand distribution characteristics of the cutter as the relative speed of the cutter reel and winder dome are varied. The improved guide hook passes the strand from the dome to the reel with minimum separation from both the reel and the remaining pressure roller.

7 Claims, 2 Drawing Sheets

FIG. 2
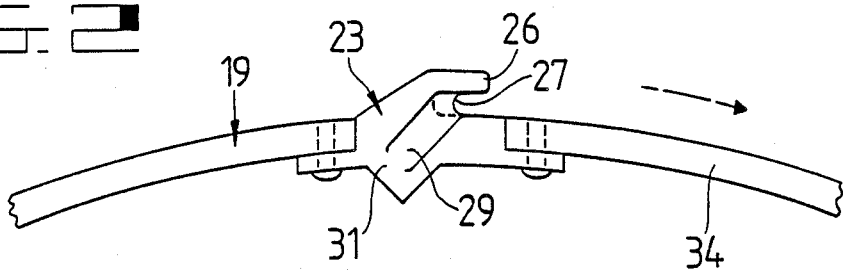
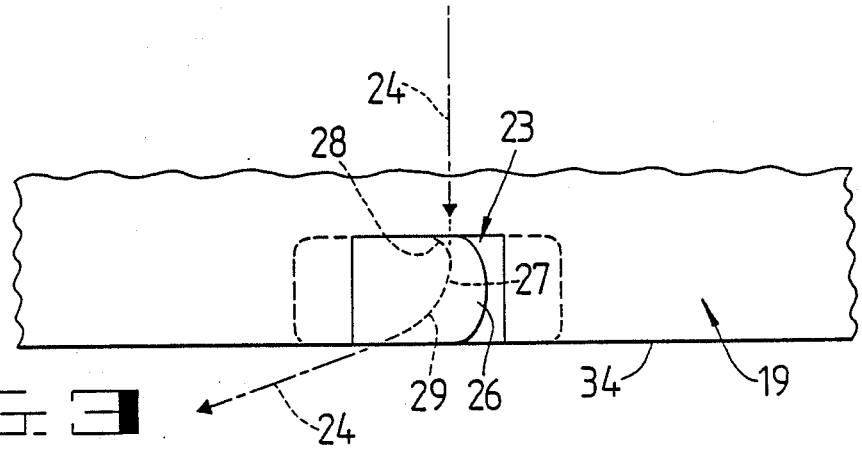
FIG. 3
FIG. 4
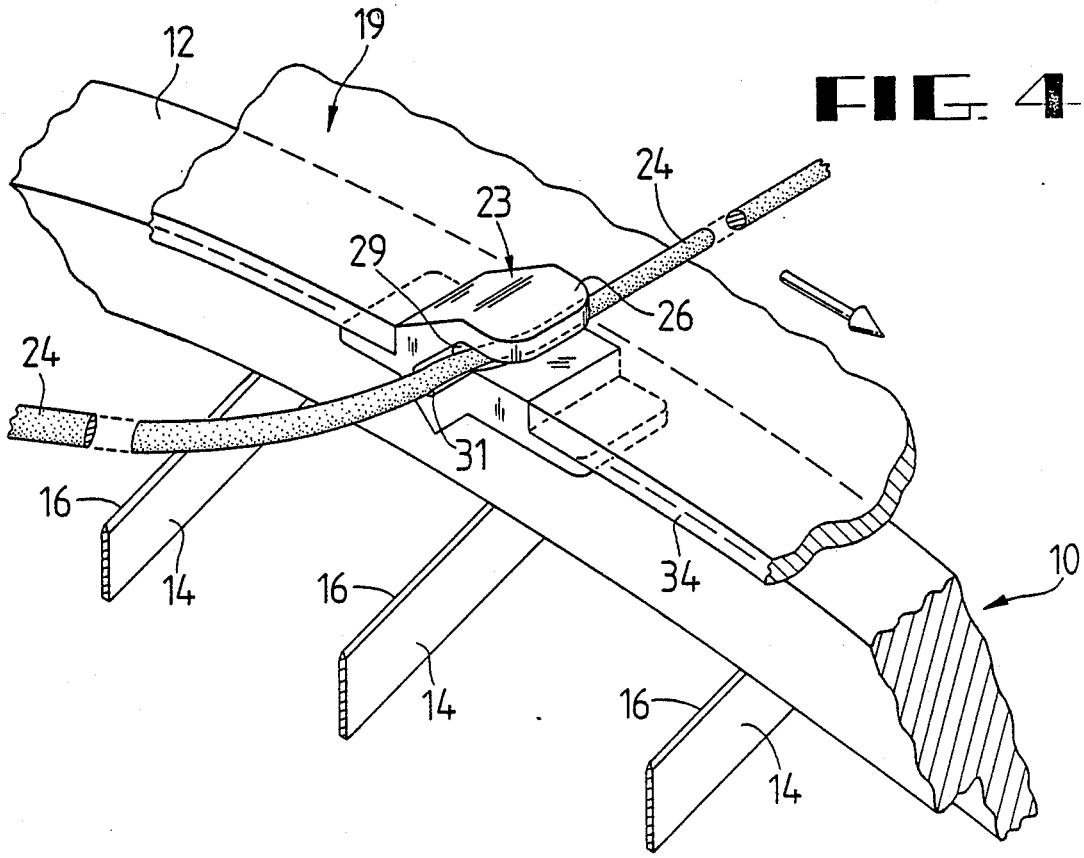

PACKAGE WIND CUTTER

FIELD OF THE INVENTION

The present invention relates to devices for cutting strands of elongated fiber-like material into staple of shorter length and more particularly to an outside-in cutter wherein the strands are wound spirally onto a cutter reel.

The present invention is an improvement over the invention disclosed in U.S. Pat. No. 4,519,281 issued May 28, 1985, which is described as an apparatus and method for cutting strand wherein a cutting head having a plurality of cutting blades forming a cutting zone rotates around one axis and a strand winding device rotates around an axis intercepting the other axis so that strand is received and stored in the cutting zone in the form of multiple crossing windings prior to cutting. The '281 apparatus uses a pair of pressure rollers, each extending over a portion of the cutting zone. One of these pressure rollers is located internally of the strand winding device thus necessitating considerable displacement of the periphery of the winding device from the cutting head. Also, the strand passes over the winding device inwardly of the outer periphery thereof, thereby necessitating displacement of the winding device from the cutting head and pressure rollers. This displacement increases the "windage" and stress on the strand and requires a larger winding device with attendant problems due to an increase in mass. While the apparatus of the '281 patent is suitable for its intended purpose, it is believed that the present invention provides considerable improvement thereover in terms of the simplicity of the device and consequently considerable savings in terms of manufacture and maintenance.

SUMMARY OF THE INVENTION

It is an object of the present invention to provide a package wind cutter having a minimal windage profile and a minimal stress profile on the strand and the winder.

Another object of the invention is to provide a package wind cutter which is simpler to manufacture, maintain and repair.

Yet another object of the invention is to improve the uniformity of the strand distribution across the face of the cutting blades.

These and other objects and advantages of the invention are advantageously accomplished in my invention by an advantageous arrangement of the winder dome, pressure roller, and guide element. An essential contribution of the present combination is the elimination of the pressure roller which is positioned inside the periphery of the winder dome in the '281 patent. The elimination of this pressure roller is made possible by the provision of a novel guide hook carried on the periphery of the winder dome which allows the tow to transition about the winder dome at the point of maximum axial extension. In the '281 apparatus, the guide was formed in the winder dome such that the winder dome extended axially beyond the strand transition or alternatively the guide itself extended axially beyond the tow transition. In either alternative, the main pressure roller was separated from the strand a distance sufficient to permit clearance of the rotating winder dome structure, thereby necessitating a secondary pressure roller to cut strand. Through the use of the novel guide hook of the present invention a single pressure roller of a width sufficient to cut the fibers can be located in close proximity to the peripheral edge of the winder dome and consequently in close proximity to the strand transition.

Elimination of the secondary pressure roller greatly facilitates manufacture and maintenance of the apparatus by eliminating structures which had to be removed to gain access to the cutter blades. Also elimination of the secondary roller permits the winder dome to have a smaller diameter, thereby reducing the cost of manufacture and more importantly, reducing the linear surface speed of the winder dome. Although the diameter of the winder dome does not affect the rate of cutting, windage against the dome which consumes drive power, windage against the strand which results in higher friction at the guide hook, and stress forces on the dome are proportional to the diameter of the dome.

The resultant structure which allows and maximizes the advantages of the elimination of the inside pressure roller may be summarized as a cutter reel, having a plurality of outwardly facing cutter blades, mounted for rotation about a first axis, a rotary winder dome mounted for counter rotation about an intersecting axis and having a diameter providing minimal separation between the dome and the reel, with the dome carrying a guide hook which directs the strand onto the reel at the axial edge of the dome, and a single pressure means, or pressure roller, located radially outwardly of the cutter blades proximal the intersection of the plane of rotation of the guide hook and the plane of rotation of the reel.

BRIEF DESCRIPTION OF THE DRAWINGS

Apparatus embodying features of my invention are illustrated in the accompanying drawings which form a portion of this application and wherein:

FIG. 2 is an axial elevational view of a portion of the edge of the winder dome showing the guide hook;

FIG. 3 is a plan view of a portion of the winder dome showing the position of the guide hook; and FIG. 4 is a perspective view partially in section and partially broken away showing the winder dome, cutter reel, and guide hook as the strand relates thereto.

DESCRIPTION OF A PREFERRED EMBODIMENT

Figure 1:
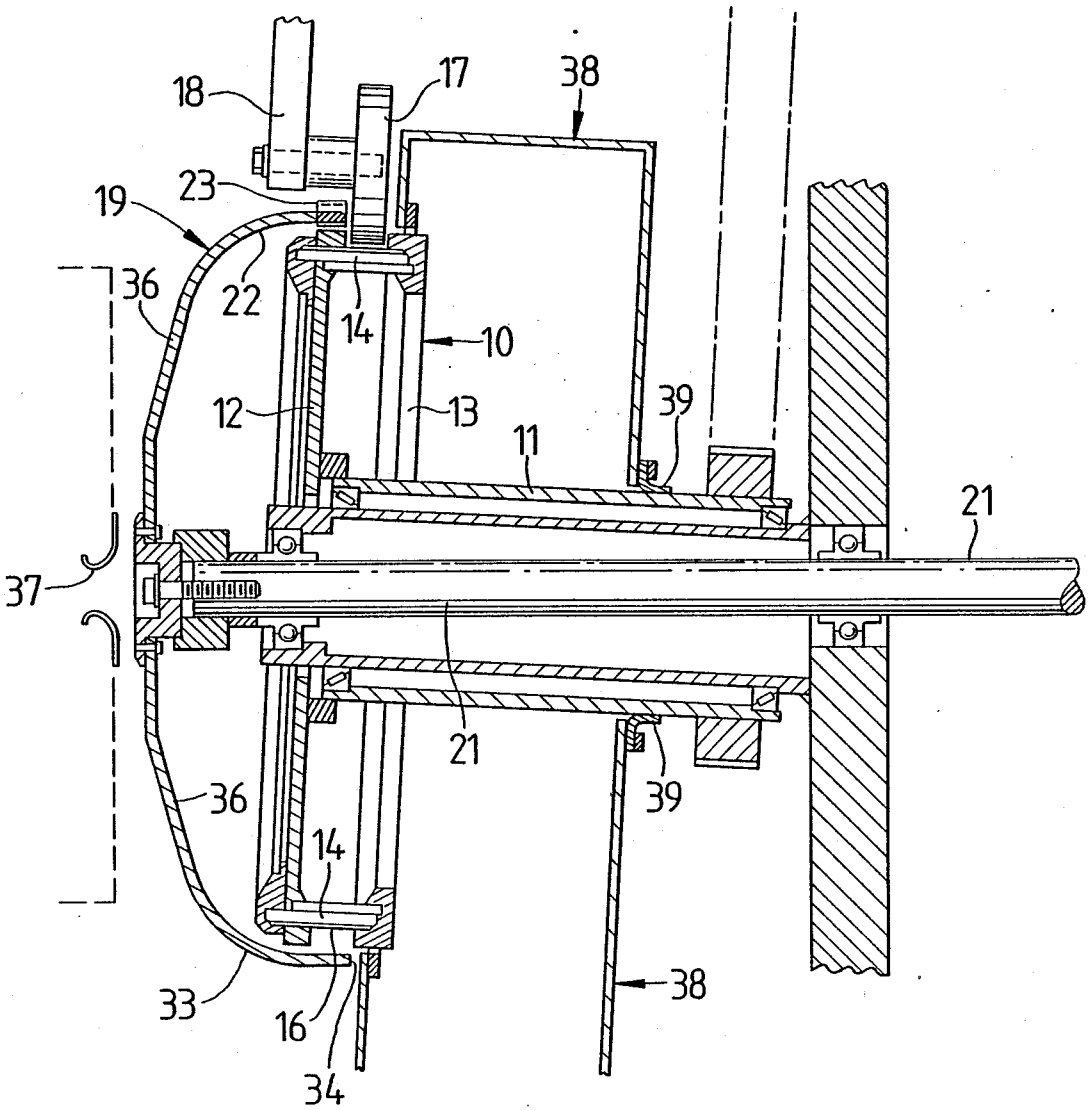
FIG. 1 is an elevational view, partially in section, of the cutter reel and winder dome combination.

Referring to FIG. 1, it will be appreciated that the drive mechanisms have been omitted for the sake of clarity and because the specific means for driving the winder dome or the cutter reel are not essential to an understanding of the present invention.

A cutter reel 10 is mounted for rotation about a first axis, which is depicted as being inclined to the horizontal, by a drive shaft 11 powered by a drive means, not shown. The cutter reel 10 includes an outer disc 12 and inner ring 13 which carry a plurality of cutter blades 14 whose knife-like edges 16 face radially outward. The disc 12 and ring 13 extend radially beyond the blades 14 to form radial flanges between which a pressure means, such as a pressure roller 17, mounted on an appropriate support arm 18 is positioned. The pressure roller 17 is spaced radially from the blades 14 as is well known and acts to urge the strand material inwardly toward the blades as succeeding layers of material are wrapped on the blades 14. The pressure roller 17 is dimensioned to occupy a large portion of the span between the flanges formed by the disc 12 and ring 13, however sufficient space is left between the pressure roller 17 and the disc 12 to admit the strand as it is delivered from a winder dome 19.

The winder dome 19 is mounted for rotation about a second axis intersecting the first axis and is driven in a direction counter to the rotation of the cutter reel 10 by shaft 21 from a drive means, also not shown. The winder dome 19 has a diameter sufficient to allow the cutter reel 10 to rotate therewithin about the first axis, yet the separation between the reel 12 and the inner surface 22 of the winder dome 19 is minimal.

The winder dome 19 carries a guide hook 23, depicted in FIGS. 2–4. The guide hook 23 directs the strand 24 through a transition from alignment with the outer surface of the winder dome 19 into alignment tangent to the arc defined by the rotation of the cutter blades 14. The guide hook 23 forms a generally radially outwardly extending lip 26 which also extends angularly in the direction of rotation of the dome to form a groove 27. The lip 26 assists in hooking the strand 24 on the fly in a reliable manner. The base of the groove 27 flares outwardly at 28 to receive the strand 24 and curves inwardly and rearwardly, relative to the motion of the guide hook 23, to form a transition surface 29 wherein the groove 27 flattens to form a discharge surface 31 which coincides with the edge 34 of the winder dome 19 at its point of closest approach to the pressure roller 17. It is noteworthy to mention that the groove 27 is continuous from the flared region at 28 to the transition surface at 29 and forms an angle of more than 90 degrees such that the strand is directed through a single gradual transition curve around the edge 34 of the winder dome 19. Contrary to this, the prior art required the strand 24 to execute two successive right angle turns, one radially inward through the guide and the second rearwardly as the strand exits the guide onto the cutter reel 10.

Referring again to FIG. 1, the winder dome 19 has a curved peripheral portion 33 which terminates at edge 34 and which curves from a conical region 36 which is truncated near the connection thereof to the drive shaft 21. The winder dome 19 is axially aligned with an outlet 37 from a spinning cabinet, not shown, or other suitable source from which the strand 24 may be discharged.

A plenum chamber 38 surrounds the drive shaft 11 and is maintained at a suitable subatmospheric pressure by a remote fan as is well known in the art. One side of the plenum chamber 38 has an aperture which fits loosely about the ring 13 and the other side carries a flexible annular seal 39 which maintains a seal about the drive shaft 11 such that air is drawn into the plenum chamber 38 proximal the cutter ring 10 such that cut staple is entrained in the air flow.

In operation the strand 24 is fed from the outlet 37 across the conical region 36 of the winder dome 19 to the curved peripheral portion 33 and the guide hook 23. The separation between the outlet 37 and the conical region 36 is minimized in the illustrated design to reduce windage effects on the strand 24 by providing an extended surface, that is the conical region 36, to support the strand 24 as it moves from the outlet 37 to the guide hook 23. The curved peripheral portion 33 serves to reduce friction of the strand 24 against the surface of the winder dome 19 as the strand 24 moves toward axial alignment.

The strand 24 then passes through the guide hook 23 such that the strand is formed into a ribbon at the discharge surface 31 which is the furthermost innermost surface on the winder dome 19 axially in the direction of strand flow into the cutter. This feature of the guide hook 23 acts to wind the strand as close as possible against the face of the pressure roller 17 and in fact the strand 24 may actually contact the face of the pressure roller 17 as the hook 23 passes the roller 17. As noted above, the groove 27 guides the strand 24 through a single relatively large radius turn of approximately 90° with minimum strand deformation and friction against the hook.

The strand 24 is wound about the cutter reel 10 on the cutter blades 14 in an unusually even distribution by virtue of the proximity of the guide hook 23 to the cutter reel 10. That is to say, distribution variations due to variation in the relative rotational speed of the cutter reel 10 and oppositely rotating winder dome 19 are minimized. It may be seen that with the cutter reel 10 stationary and the winder dome 19 rotating the strand will be laid on the blades 14 of the cutter reel 10 in the plane of rotation of the discharge surface 31. On the other hand, if the winder dome 19 is stationary and the cutter reel 10 is rotating, the strand will wind on the blades 14 in a plane through the surface 31 perpendicular to the axis of the cutter reel. It can be seen that the larger the winder dome 19, the greater the disparity there will be in the distribution of the strand axially on the reel as the ratio of the speeds between the winder dome and reel is varied. The difference in strand distribution along the axis becomes negligible when the discharge point of the hook is very close to the surface of the tow on the reel. However, when the hook must pass over the inside pressure roller of the prior art, the axial distribution variation as the ratio of speeds is varied becomes substantial.

While I have shown my invention in one form, it will be obvious to those skilled in the art that it is not so limited but is susceptible of various changes and modifications without departing from the spirit thereof.

What I claim is:

1. Apparatus for cutting elongated fiber-like material into shorter lengths, comprising:

(a) a driven rotary cutter reel having an inner and outer member carrying a plurality of radially outwardly facing knives therebetween, said reel being mounted for rotation about a first axis;

(b) a single pressure roller mounted radially outwardly of said knives and extending between said inner and outer members to define a cutting zone within said reel, said zone extending only partially across said knives;

(c) a driven rotary winder dome mounted for rotation about a second axis intersecting said first axis for wrapping spiral layers of fiber-like material between onto said knives within said cutting zone, by passing said fiber-like material between said outer member and said pressure roller, said winder dome having a maximum diameter less than the combined diameter of said reel and said pressure roller and including a material guide means disposed for rotation about said reel with minimal radial separation therebetween and wherein said guide means discharges said material at the outermost axial projection of said winder dome toward said pressure roller, and said pressure roller is located proximal the region of minimal separation between said guide member and said outer member of said cutter reel.

2. Apparatus as defined in claim 1 wherein said guide means is a hook including a generally radially outwardly projecting portion and a generally radially inwardly disposed portion with said hook forming a continuous transition surface for guiding said fiber-like material from the outer surface of said winding means to said knives.

3. Apparatus as defined in claim 2 wherein said transition surface extend into a plane perpendicular to the axis of rotation of said winder dome such that said fiber-like material assumes a ribbon-like cross-section as it exits the transition surface.

4. Apparatus as defined in claim 1 wherein said guide means forms a transition surface through which said fiber-like material passes such that the cross-section area of said material transitions from substantially round in shape to substantially ribbon-like in shape.

5. Apparatus as defined in claim 1 wherein said guide means is a hook-like member carried on the periphery of said winder dome with said hook defining a transition surface extending in a substantially axial direction along the outer surface of said winder dome and extending inwardly of said winder dome along a chord thereof substantially tangent to the arc of rotation of said knives, such that said transition surface defines a continuous arc of approximately 90°.

6. Apparatus as defined in claim 1 wherein said rotary winder means includes a transfer surface having a minimum windage profile.

7. Apparatus as defined in claim 6 wherein said transfer surface comprises:

(a) an annular hub symmetric about the axis of rotation of said winder means in the form of a truncated cone; and (b) a curved peripheral region wherein said surface is aligned with said axis of rotation, with said guide means located along the outer edge of said peripheral region.

* * * * *